US005088289A

United States Patent [19]

Mita et al.

[11] Patent Number: 5,088,289

[45] Date of Patent: Feb. 18, 1992

[54] REFRIGERATION SYSTEM

[75] Inventors: Hideo Mita, Okazaki; Akiyoshi Hirano, Toyota; Yoshihira Shiroshita, Toyoake, all of Japan

[73] Assignee: Aisin Seiki Kabushiki Kaisha, Kariya, Japan

[21] Appl. No.: 674,956

[22] Filed: Mar. 26, 1991

[30] Foreign Application Priority Data

Mar. 31, 1990 [JP] Japan ..... 2-85874

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS 4,335,579 6/1982 Sugimoto ..... 62/6
4,498,296 2/1985 Dijkstra et al. ..... 62/6
4,700,545 10/1987 Ishibashi et al. ..... 62/6
4,845,953 7/1989 Misawa et al. ..... 62/6
4,891,951 1/1990 Ishibashi ..... 62/51.3

*Primary Examiner*—Ronald C. Capossela
*Attorney, Agent, or Firm*—Oblon, Spivak, McClelland, Maier & Neustadt

[57] ABSTRACT

A refrigeration system includes a refrigerator having a compression portion having a cylinder and a piston moving slidably in the cylinder, a first heat exchanger, a regenerator, a second heat exchanger, and an expansion portion having a bellows and a head formed integrally with the bellows. The piston is driven via a first rod and the head via a second rod. The cylinder has a large diameter portion where the piston is slidably moved and a small diameter portion where the rod is slidably moved.

4 Claims, 4 Drawing Sheets

REFRIGERATION SYSTEM

BACKGROUND OF THE INVENTION

1. Field of the Invention

The present invention relates to a refrigeration system and more particularly to a refrigeration system able to achieve a temperature under 6 degrees in Kelvin from the combination of a main-refrigerator and a sub-refrigerator.

2. Description of the Related Art

A conventional refrigeration system 100, as shown in FIG. 4, is disclosed in U.S. Pat. No. 4,891,951. In the refrigeration system 100, a compression portion 101 which is formed by a bellows 111 is in fluid communication with an expansion portion 105 which is formed by a bellows 112 via a heat radiation apparatus 102, a heat generator 103, a condenser 104 and a conduit 110. The bellows 111, 112 are connected to rods 113, 114, respectively. Rods 113, 114 are driven, with a predetermined phase difference, by a driver 115. Thus, a refrigerating machine C is constituted and a very low temperature is generated at the expansion portion 105.

In a vacuum casing 117, a vessel 107 and the refrigerating machine C are positioned, except for the driver 115. An amount of liquid helium 106 is stored in the vessel 107 and a vapor phase 116 is defined above the liquid helium 106. A substance 118 to be cooled is immersed in the liquid helium 106. The vessel 107 is in fluid communication with the condenser 104 via a first conduit 108 and a second conduit 109.

In the conventional refrigeration system 100, a stroke of the bellows 111 is larger than a stroke of the bellows 112, and the bellows 111, 112 are made of metal members. Therefore, fatigue fracture easily occurs in the bellows 111.

SUMMARY OF THE INVENTION

Accordingly, it is a primary object of the present invention to prevent the compression portion from experiencing fatigue fracture.

The above and other objects are achieved according to the present invention by a refrigeration system which comprises a refrigerator including a compression portion having a cylinder and a piston moving slidably in the cylinder, a first heat exchanger, a regenerator, a second heat exchanger, and an expansion portion having a bellows and a head formed integrally with the bellows, and a driving means to drive the piston via a first rod and the head via a second rod. The cylinder comprises a large diameter portion where the piston is slidably moved and a small diameter portion where the rod is slidably moved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
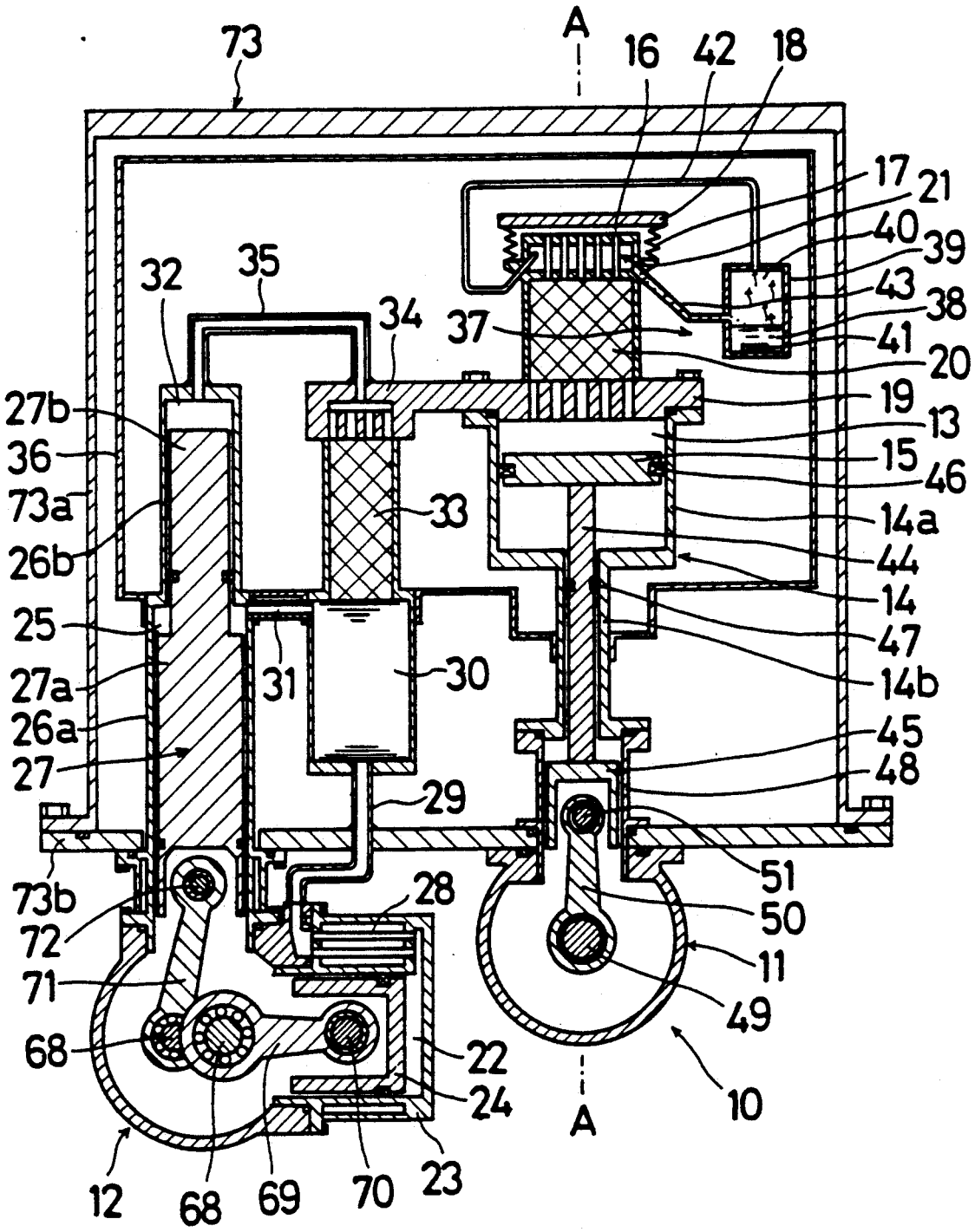
FIG. 1 is a cross-sectional view of a refrigeration system according to one embodiment of the invention.
Figure 2:
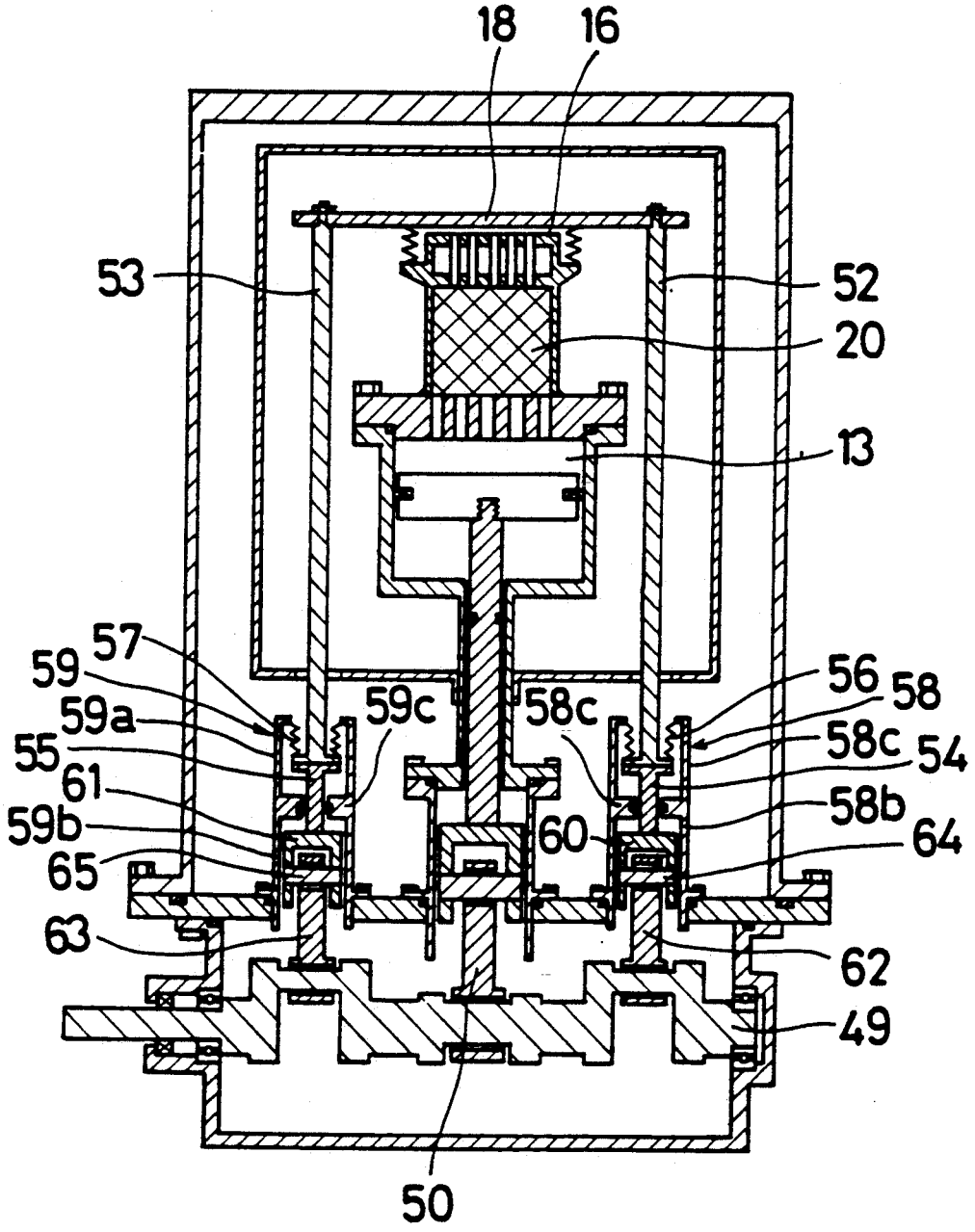
FIG. 2 is a cross-sectional view of FIG. 1 taken along line A—A in FIG. 1.

Referring first to FIGS. 1, 2 wherein a refrigeration system 10 is shown. The refrigeration system 10 is the combination of a main-refrigerator 11 and a sub-refrigerator 12 each of which uses a Stirling cycle. In the main-refrigerator 11, a compression portion 13 which is formed by a cylinder 14 and a piston 15 is in fluid communication with an expansion portion 16 which is formed by a bellows 17 and a head 18 via a heat exchanger (first heat exchanger) 19, a regenerator 20 and a condenser (second heat exchanger) 21.

In the sub-refrigerator 12, a compression portion 22 which is formed by a cylinder 23 and a piston 24 is in fluid communication with a first expansion portion 25 which is formed by a cylinder **26*a* and an upper portion 27*a* of a piston 27 via a heat radiation apparatus 28, a conduit 29, a first regenerator 30 and a conduit 31. Furthermore, the compression portion 22 is in fluid communication with a second expansion portion 32 which is formed by a cylinder 26*b* and a lower portion 27*b* of the piston 27 via the heat radiation apparatus 28, the conduit 29, the first regenerator 30, a second regenerator 33, a heat exchanging member 34 and a conduit 35. The heat exchanger 19 is thermally connected with the heat exchanging member 34**.

The compression portion 13, expansion portion 16, heat exchanger 19, regenerator 20, condenser 21, second expansion portion 32, second regenerator 33, heat exchanging member 34, conduit 35 and a cooled means 37 are located in a thermal shield casing 36.

In the cooled means 37, an amount of liquid helium 38 is stored in a vessel 39 and a vapor phase 40 is defined above the liquid helium 38. A substance 41 to be cooled is immersed in the liquid helium 38. The vessel 39 is in fluid communication with the condenser 21 via a first conduit 42 and a second conduit 43.

In the main-refrigerator 11, one end of a rod (first rod) 44 is connected to the piston 15, and the other end of the rod 44 is connected to a guide piston 45. The piston 15 is slidably moved upwardly and downwardly in a large diameter portion **14*a* of the cylinder 14 and is sealed via a ring 4*b* preferably made from Teflon (commercially available from DuPont) plus a filler, and the rod 44 is slidably moved upwardly and downwardly in a small diameter portion 14*b* of the cylinder 14 and sealed via a ring 47. The diameter of the small diameter portion 14*b* is sufficiently smaller than the diameter of the large diameter portion 14*a* to prevent substantial atmospheric heat from invading the compression portion 13**.

In a cylinder 48, the guide piston 45 is slidably moved upwardly and downwardly, and is driven by a crank shaft 49 which is connected to a driving means (not shown, e.g., an electric motor), via a connecting rod 50 and a pin 51.

One end of a rod of a pair of second rods 52 (53) is connected to the head 18, and the other end of the rod 52 (53) is connected to one end of a rod of a pair of rods 54 (55) with sealing via a bellows of a pair of bellows 56 (57). An inner end of the bellows 56 (57) is fitted to the rod 52 (53), and an outer end of the bellows 56 (57) is fitted to an upper portion 58a (59a) of a guide cylinder of a pair of guide cylinders 58 (59). The other end of the rod 54 (55) is connected to the end of a guide piston of a pair of guide pistons 60(61). In a lower portion 58b (59b) of the guide cylinder 58 (59), the guide piston 60 (61) is slidably moved upwardly and downwardly, and is driven by the crank shaft 49 via a connecting rod of a pair of connecting rods 62 (63) and a pin of a pair of pins 64 (65). The phase of the guide piston 45 is shifted 75~90 degrees behind the phase of the guide piston 60 (61). Namely, the phase of the compression portion 13 is shifted 75~90 degrees behind the phase of the expansion portions 16. A flange portion 58c (59c) is formed on a respective one of the guide cylinders 58 (59) between the upper portion 58a (59a) and the lower portion 58b (59b). A sealing ring 66 (67) is located between the rod 54 (55) and the flange portion 58c (59c).

In the sub-refrigerator 12, the piston 24 is driven by a crank shaft 68 which is connected to a driving means (not shown, e.g., an electric motor) via a connecting rod 69 and a pin 70. The piston 27 is driven by the crank shaft 68 via a connecting rod 71 and a pin 72. The phase of the guide piston 24 is delayed by 90 degrees relative to the phase of the guide piston 27. Namely, the phase of the compression portion 22 is shifted 75~90 degrees behind the first and second expansion portions 25,32.

A vacuum casing 73 comprises a body 73a and a cover 73b. The vacuum casing 73 is kept in vacuum condition. The refrigeration system 10, except for the driving constructions, the compression portion 22 and the heat radiation apparatus 28, is located in the vacuum casing 73.

The function or operation of the system 10 will be described as follows:

In the sub-refrigerator 12, the working gas (e.g., helium gas) having a pressure of about 20 kg/cm$^2$ is pumped between the compression portion 22 and the first expansion portion 25 and between the compression portion 22 and the second expansion portion 32. Due to the driving of the sub-refrigerator 12, refrigeration at 80 degrees Kelvin is generated at the first expansion portion 25, and refrigeration at 15~30 degrees Kelvin is generated at the second expansion portion 32. So, the heat exchanging member 34 and the heat radiation apparatus 19 are cooled to about 15~30 degrees Kelvin.

In the main-refrigerator 11, the working gas (e.g., helium gas) having a pressure of about 1 kg/cm$^2$ is pumped between the compression portion 13 and the first expansion portion 16. Namely, the working gas which is compressed in the compression portion 13 flows through the heat radiation apparatus 19. At this time, the working gas is cooled by the refrigeration at 15~30 degrees Kelvin generated at the sub-refrigerator 12. Next, the working gas flows through the heat accumulator 20, and is further cooled thereby. Next, the working gas flows into the expansion portion 16 via the condenser 21. Here, the working gas expands isothermally with the moving of the head 16 upwardly. Refrigeration at about 4.2 degrees Kelvin is thus generated.

Next, the working gas flows back through the condenser with the moving of the head 16 downwardly. Then, the helium vapor in the vapor phase 40 of the vessel 39 flows into the condenser 21 via the first conduit 42, and is condensed in the condenser 21 by refrigeration at 4.2 degrees Kelvin. Therefore, the helium vapor changes to liquid helium, and the liquid helium flows into the vessel 39 via the second conduit 43.

Finally, the working gas flows back into the compression portion 13 via the heat accumulator 20 and the heat radiation apparatus 19 while increasing the temperature thereof, and the first cycle of the Stirling cycle of the main refrigerator 11 ends.

Figure 4:
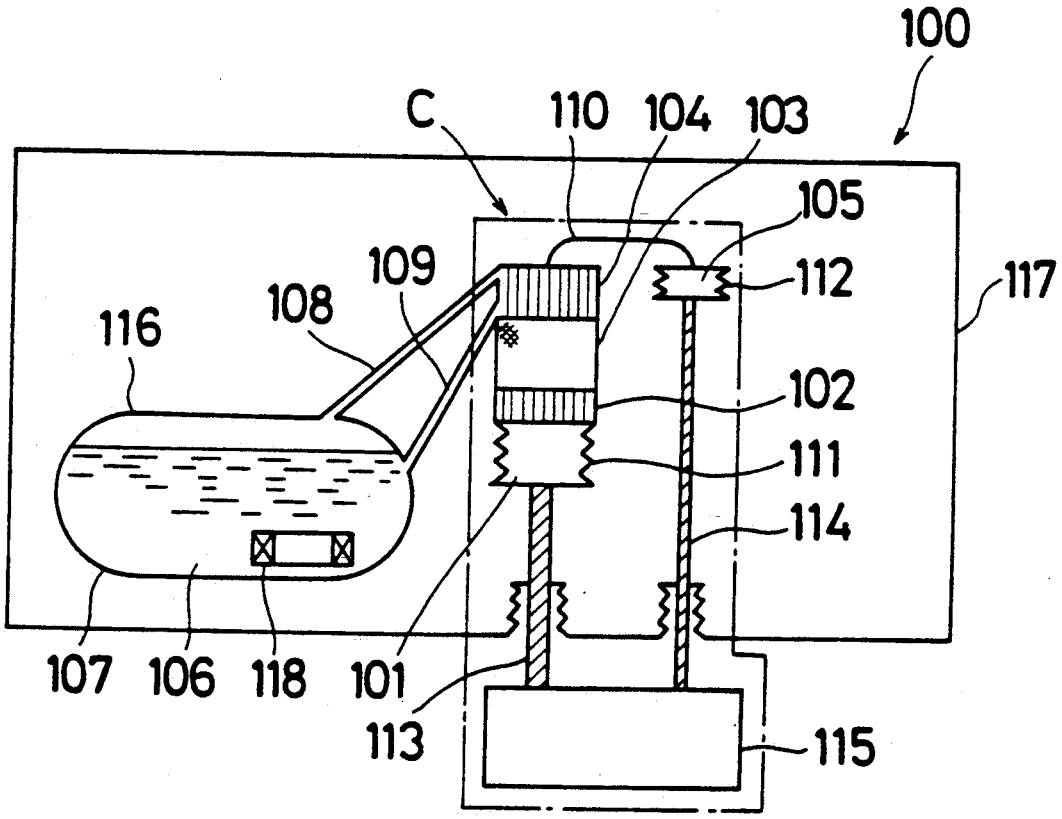
Fig. 4 (PRIOR ART)
FIG. 4 is a cross-sectional view of a conventional refrigeration system.

It may be appreciated that the conventional bellows 111 of FIG. 4 has been replaced by a sealed piston with minimal heat transfer to the compression portion 13. The small sectional area of the rod 44 limits the amount of heat transferred by its reciprocation. The seal ring 47 prevents atmospheric gas from reaching the large diameter portion 14a..

Figure 3:
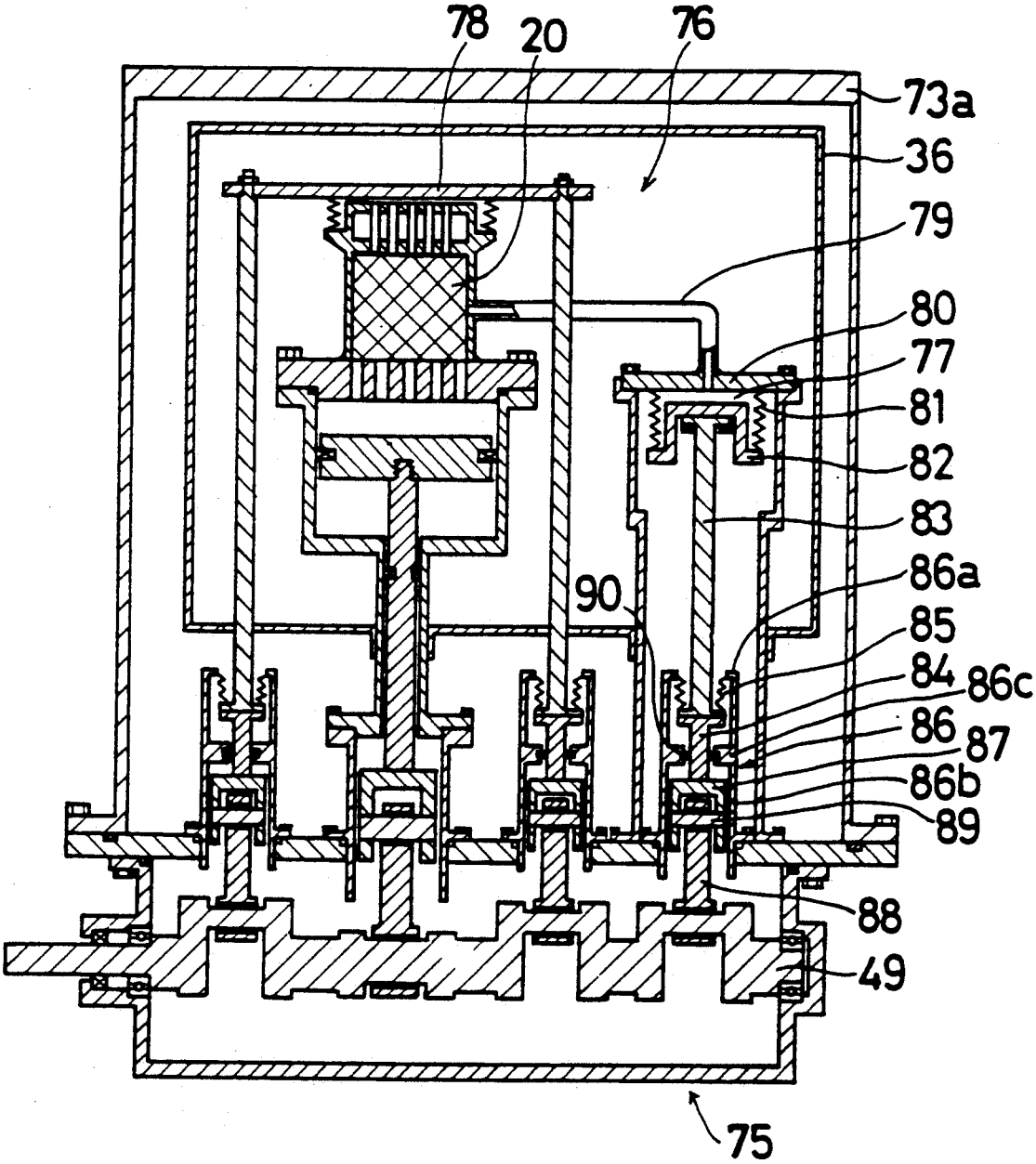
FIG. 3 is a cross-sectional view of a refrigeration system according to another embodiment of the invention.

Next, referring to FIG. 3, which shows a refrigeration system 75 of a second embodiment according to the present invention, only the construction different from the first embodiment will be described hereinafter.

In the second embodiment, the main refrigerator 76 has first and second expansion portions 77,78, and the capacity of the first expansion portion 77 is about the same as the capacity of the second expansion portion 78. So, the working gas goes and returns between the compression portion 13 and the first expansion portion 77 and between the compression portion 13 and the second expansion portion 78. A conduit 79 is interposed between the heat accumulator 20 and the first expansion portion 77.

The first expansion portion 77 comprises a head 80, bellows 81 and piston 82. One end of a rod 83 is connected to the piston 82 and the other end of the rod 83 is connected to one end of a rod 84 and is sealed via a bellows 85. An inner end of the bellows 85 is fitted to the rod 84, and an outer end of the bellows 85 is fitted to an upper portion 86a of a guide cylinder 86. The other end of the rod 84 is connected to the guide piston 87. In a lower portion 86b of the guide cylinder 86, the guide piston 87 is slidably moved upwardly and downwardly, and is driven by the crank shaft 49 via a connecting rod 88 and a pin 89. The phase of the guide piston 45 is shifted by 60~90 degrees behind the phase of the guide piston 87. Namely, the phase of the compression portion 13 is shifted 60~90 degrees behind the phase of the second expansion portion 77. A flange portion 86c is formed on the guide cylinder 86 between the upper portion 86a and the lower portion 86b. A sealing ring 90 is located between the rod 84 and the flange portion 86c.

Because the capacity of the first expansion portion 77 is about the same as the capacity of the second expansion portion 78, the expanding and contracting quantity of the bellows 17, 81 is smaller than in the first embodiment. Thus, the life of the bellows 17, 81 increases.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A refrigeration system comprising:

a refrigerator including a compression portion having a cylinder and a piston moving slidably in the cylinder to define a compression portion;

a first heat exchanger in thermal communication with the compression portion;

a regenerator in thermal communication with the first heat exchanger;

a second heat exchanger in thermal communication with the regenerator; and an expansion portion in thermal communication with the second heat exchanger and having a bellows and a head formed integrally with the bellows; and driving means for driving the piston, the driving means including a first rod driving the piston and a second rod driving the head, wherein the cylinder comprises a large diameter portion within which the piston is slidably moved and a small diameter portion within which the first rod is slidably moved.

2. A refrigeration system as set forth in claim 1, wherein the refrigerator is comprised of a main-refrigerator and a sub-refrigerator, and wherein a sub heat exchanger is thermally connected with the first heat exchanger.

3. A refrigeration system as set forth in claim 1, including sealing means providing sealing between the first rod and the small diameter portion.

4. A refrigeration system as set forth in claim 1, wherein said expansion portion comprises first and second expansion portions having substantially equal capacities.

* * * * *